US007237280B1

(12) United States Patent
Holden, Jr. et al.

(10) Patent No.: US 7,237,280 B1
(45) Date of Patent: Jul. 3, 2007

(54) TUB OVERFLOW ASSEMBLY

(75) Inventors: R. Stuart Holden, Jr., Farmington, CT (US); Chris Graham, Portland, CT (US); Frank Pieters, Pointe-Claire (CA)

(73) Assignee: The Keeney Manufacturing Company, Newington, CT (US)

( * ) Notice: Subject to any disclaimer, the term of this patent is extended or adjusted under 35 U.S.C. 154(b) by 353 days.

(21) Appl. No.: 11/039,033

(22) Filed: Jan. 20, 2005

(51) Int. Cl.
*E03C 1/22* (2006.01)
*E03C 1/244* (2006.01)

(52) U.S. Cl. ..... 4/680; 4/694

(58) Field of Classification Search ..... 4/679–680, 4/694, 538; 285/3
See application file for complete search history.

(56) References Cited

U.S. PATENT DOCUMENTS

| | | | | |
|---|---|---|---|---|
| 4,910,807 | A | 3/1990 | Willis | 4/199 |
| 5,257,648 | A | 11/1993 | Oropallo | 138/90 |
| 5,273,077 | A | 12/1993 | Oropallo | 138/90 |
| 5,507,501 | A | 4/1996 | Palmer | 277/9 |
| 5,890,241 | A | 4/1999 | Ball | 4/538 |
| 6,138,298 | A | 10/2000 | Ball | 4/694 |
| 6,182,704 | B1 | 2/2001 | Bevacco | 138/89 |
| 6,192,531 | B1 | 2/2001 | Fritz et al. | 4/679 |
| 6,272,699 | B1 | 8/2001 | Peterson | 4/680 |
| 6,289,532 | B1 | 9/2001 | Fritz et al. | 4/679 |
| 6,295,664 | B2 | 10/2001 | Fritz et al. | 4/679 |
| 6,484,331 | B2 | 11/2002 | Minnick | 4/694 |
| 6,588,454 | B1 | 7/2003 | Johnson et al. | 138/90 |
| 6,622,748 | B2 | 9/2003 | Duncan | 137/68.3 |
| 6,637,050 | B1 | 10/2003 | Ball | 4/680 |
| 6,675,406 | B2 | 1/2004 | Ball | 4/683 |
| 6,681,420 | B1 | 1/2004 | Ball | 4/680 |
| 6,691,411 | B2 | 2/2004 | Ball | 29/890 |
| 2002/0032926 | A1* | 3/2002 | Lewis | 4/680 |
| 2002/0139427 | A1 | 10/2002 | Duncan | 138/90 |
| 2003/0111125 | A1 | 6/2003 | Johnson et al. | 138/90 |

* cited by examiner

*Primary Examiner*—Gregory L. Huson
*Assistant Examiner*—Kristie Mahone
(74) *Attorney, Agent, or Firm*—Alix, Yale & Ristas, LLP

(57) ABSTRACT

An overflow assembly employs an overflow elbow having an externally threaded cylindrical fitting that extends through the tub overflow opening. An internally threaded retainer nut with integrally molded test cap is threadably engaged over the overflow elbow cylindrical fitting to compress gaskets against both the inside and outside surfaces of the tub. A test cap is integrally molded with the retainer nut and joined to the retainer nut by a thin, breakable connection. An undercut lip on the test cap facilitates use of a prying tool to break the thin connection and remove the test cap after testing of the drain plumbing. A trim cap snaps over the retainer nut to provide a finished appearance to the installed overflow assembly.

9 Claims, 5 Drawing Sheets

2D
34
38
3
3

2b
34
40
38
39
38
See Fig. 5
See Fig. 6

2D
34
38

34
44
48

48
46

TUB OVERFLOW ASSEMBLY

BACKGROUND OF THE INVENTION

1. Field of the Invention

The invention relates generally to bathtub overflow assemblies and more particularly to an overflow assembly equipped with a test cap to permit pressure testing of the waste plumbing during construction.

2. Description of the Related Art

In new construction, plumbers are required to test the assembled waste or drain plumbing of a structure before closure of wall and ceiling surfaces. Such testing is performed under pressure to detect leaks or flaws in the waste plumbing system so that such leaks are repaired while the plumbing is still easily accessible.

Bathtub overflow assemblies are well-known plumbing fixtures that connect the overflow opening of a bathtub to the bathtub drain. The overflow opening in the bathtub is typically positioned on an end wall of the bathtub at a pre-selected elevation to limit the maximum level of water in the tub and prevent bathtub overflow. Water above the level of the overflow opening is safely drained through the opening and overflow assembly into the bathtub drain.

The overflow assembly typically includes an overflow elbow having an inverted L-shape. An inlet of the overflow elbow is sealingly engaged with the bathtub overflow opening. The overflow elbow provides a flow passage extending downwardly to connect the bathtub overflow opening with the bathtub drain. There are a number of well-known arrangements for fixing the inlet of the overflow elbow to the bathtub overflow opening in sealed relationship. The integrity of this seal is important to prevent water leaking around the overflow elbow.

An overflow assembly relevant to the present invention is shown in U.S. Pat. Nos. 6,675,406 and 6,637,050. The overflow elbow is provided with a radially extending flange positioned to compress a sealing gasket against the outside surface of the tub around the tub overflow opening. A cylindrical fitting having a threaded outside surface extends through the tub overflow opening and is threadably engaged by a retainer nut that bears against the inside surface of the tub. A thin diaphragm is sealed over the end of the overflow elbow to seal the overflow inlet during testing of the drain plumbing. After testing, the thin diaphragm is cut away and a trim cap is placed over the inner end of the overflow elbow and retainer nut to provide a finished appearance to the installed assembly. One potential drawback to this approach is that the thin diaphragm can be damaged during manufacture, shipping or installation of the overflow assembly. A damaged diaphragm would require replacement of the overflow elbow or some alternative means of sealing the overflow inlet during testing of the drain plumbing.

It is also known to provide a threaded test cap separate from the threaded retainer nut to cover the overflow inlet during testing of the drain plumbing. After testing, the test cap is unthreaded from the inner end of the overflow elbow and the decorative cap is installed. Manufacture and packaging of separate retainer nuts and test caps is costly and presents the potential that one or the other may be omitted from the packaged assembly.

A further alternative overflow assembly configuration is disclosed in U.S. Pat. No. 6,484,331 (the '331 patent). The '331 patent overflow assembly includes an overflow elbow having an internally threaded overflow opening that receives one end of an externally threaded overflow cap extending through the tub overflow opening. A gasket is compressed between the overflow elbow and the outside surface of the tub around the overflow opening. The overflow cap includes a test cap molded integrally with the overflow cap. The test cap is molded with a thin, breakable connection to the overflow cap such that, after testing of the drain plumbing system, the test cap is broken away from the overflow cap to open the overflow inlet. A potential drawback of the '331 overflow assembly structure is that the threaded joint between the overflow cap and the overflow elbow is positioned outside the tub. This presents the potential for leakage that is not present in an overflow elbow configured to extend integrally through the tub overflow opening.

SUMMARY OF THE INVENTION

The present invention employs an overflow elbow having an externally threaded cylindrical fitting that extends integrally through the tub overflow opening. An internally threaded retainer nut with integrally molded test cap is threadably engaged with the overflow cylindrical fitting to compress gaskets against both the inside and outside surfaces of the tub. The test cap is integrally molded with the retainer nut with a thin, breakable connection between the nut and cap. An undercut lip on the test cap facilitates use of a prying tool to break the thin connection and remove the test cap after testing of the drain plumbing.

The tub overflow assembly includes an overflow elbow, an outside gasket, an inside gasket, an o-ring seal, the integrated retainer nut and test cap and a trim cap. The outside gasket is a thick sponge type gasket configured for compression between a radially extending flange of the overflow elbow and the outside surface of the tub around the overflow opening. The inside gasket is a flat rubber gasket that is compressed between one end of the retainer nut and the inside surface of the tub around the overflow opening. The retainer nut is configured with a channel or seat for the inside gasket. The inside gasket prevents water from escaping from behind the retainer nut and through the overflow opening. The outside gasket is configured to stop any water that may get past the inside gasket.

The overflow elbow includes a cylindrical fitting configured to extend through the tub overflow opening and into the tub. The cylindrical fitting has a generally cylindrical outside surface with a threaded section and an unthreaded section including a groove that receives an o-ring seal. The threaded section of the cylindrical fitting outside surface is adjacent the flange and the unthreaded section extends from the threaded section. The retainer nut has a generally cylindrical configuration complementary to the cylindrical fitting. The retainer nut inside surface is partially threaded and partially unthreaded. The unthreaded portion of the retainer nut inside surface is configured to radially compress and seal against the o-ring seal retained in the groove defined by the cylindrical fitting unthreaded section. The depth of the inside surface of the retainer nut and the overlapping cylindrical configuration of the overflow elbow and retainer nut and test cap accommodate variations in the thickness of the bathtub wall.

The test cap is molded integrally with the retainer nut to extend across and close the unthreaded end of the generally cylindrical retainer nut. The integrated test cap permits testing of the drain plumbing without installation of an additional component. After testing, a prying tool is inserted beneath an undercut lip on the test cap and used to pry the test cap away from the retainer nut. The retainer nut and test cap are integrally molded from ABS plastic with a thin skin of approximately 0.020 thickness surrounding the test cap and connecting the test cap to the retainer nut cylindrical portion. The periphery of the retainer nut includes lugs having an undercut beveled edged adjacent the inside surface of the tub. This undercut edge receives a complementary protrusion on the trim cap such that the trim cap is engaged over the retainer nut in a snap fit.

DETAILED DESCRIPTION OF THE PREFERRED EMBODIMENT

Figure 1:
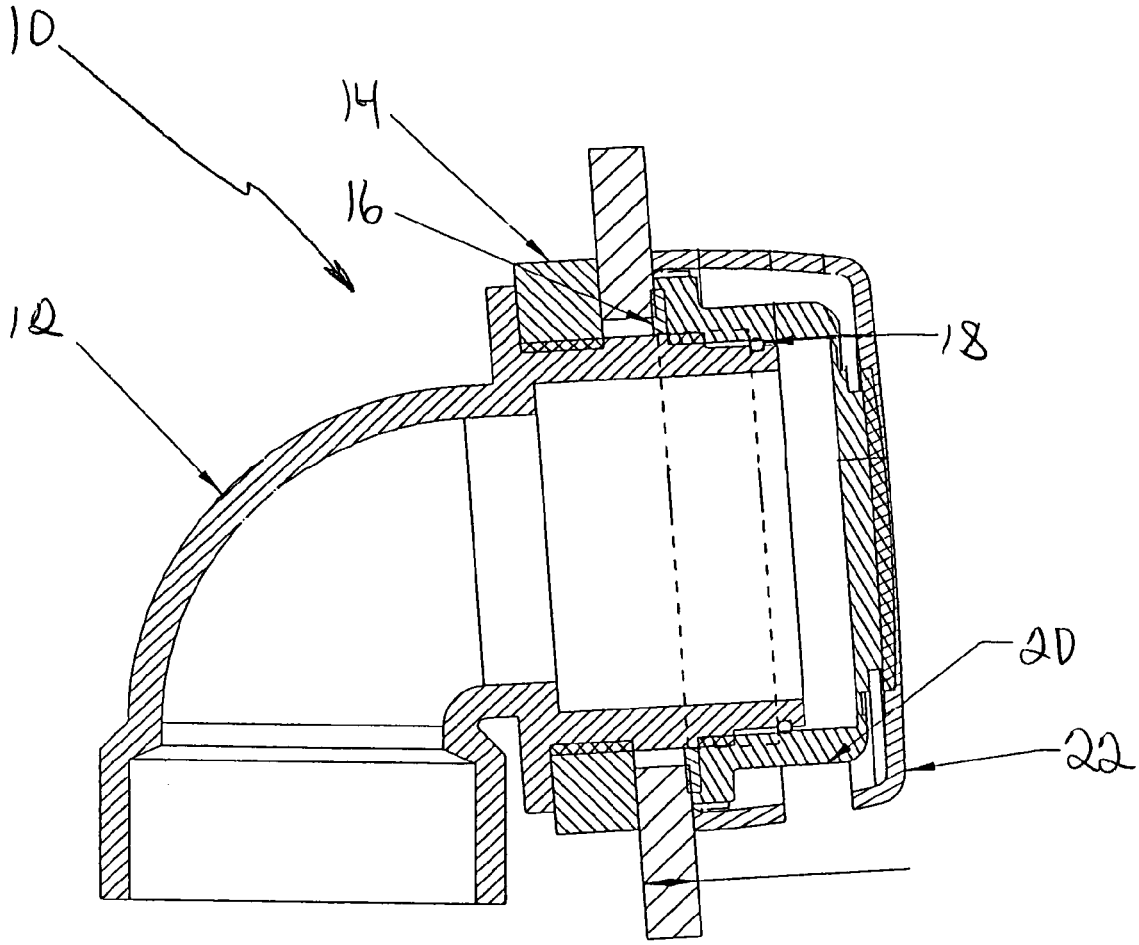
FIG. 1 is a side sectional view through an overflow assembly and adjacent portions of a tub wall according to aspects of the present invention.

The inventive overflow assembly will now be described with reference to FIGS. 1–17. FIG. 1 is a vertical sectional view through the six components of the overflow assembly 10. The overflow assembly includes the overflow elbow 12, an outside gasket 14, an inside gasket 16, an o-ring seal 18, a retainer nut with integrally molded test cap 20, and a trim cap 22.

The overflow elbow 12 is molded from PVC or ABS plastic for compatibility with the plastic employed in the remainder of the drain plumbing system. The overflow elbow 12 extends from a lower end portion defining a socket 24 configured to receive standard plastic pipe to an upper end portion including a cylindrical fitting 26 configured to extend into a bathtub through the tub overflow opening. The overflow elbow 12 is so called because of its inverted L-shape, which provides a flow passage extending downwardly to facilitate connection of the tub overflow opening with the bathtub drain. A flange 28 radially projects from a rear end of the cylindrical fitting 26 of the overflow elbow 12. This flange engages the outside gasket 14 to compress it against the outside surface of the tub surrounding the overflow opening. The outside surface of the cylindrical fitting 26 includes a threaded section 26*a* adjacent the flange 28 and an unthreaded section 26*b* extending from the threaded portion 26*a*. The unthreaded portion 26*b* defines a circumferential groove 30 configured to receive the O-ring seal 18.

As shown in FIGS. 2–6, the retainer nut 20 has a generally cylindrical configuration extending between a lug formation 32 at a first end to an integrally molded test cap 34 closing a second end. The inside surface of the generally cylindrical side wall 36 of the retainer nut has a partially threaded portion 38 and an unthreaded portion 40. The side wall 36 and its threaded and unthreaded surfaces 38, 40 allow the overflow assembly to accommodate bathtubs having walls of varying thickness. The depth 39 of the retainer nut 20 permits tightening of the assembly and compression of the inside and outside gaskets 16, 14 against the tub without bottoming the threads. The unthreaded portion 40 of the side wall 36 is configured to sealingly engage the o-ring seal 18 seated in the circumferential groove 30 of the overflow elbow as shown in FIG. 1.

Figures 2, 3, 4, 5, 6:
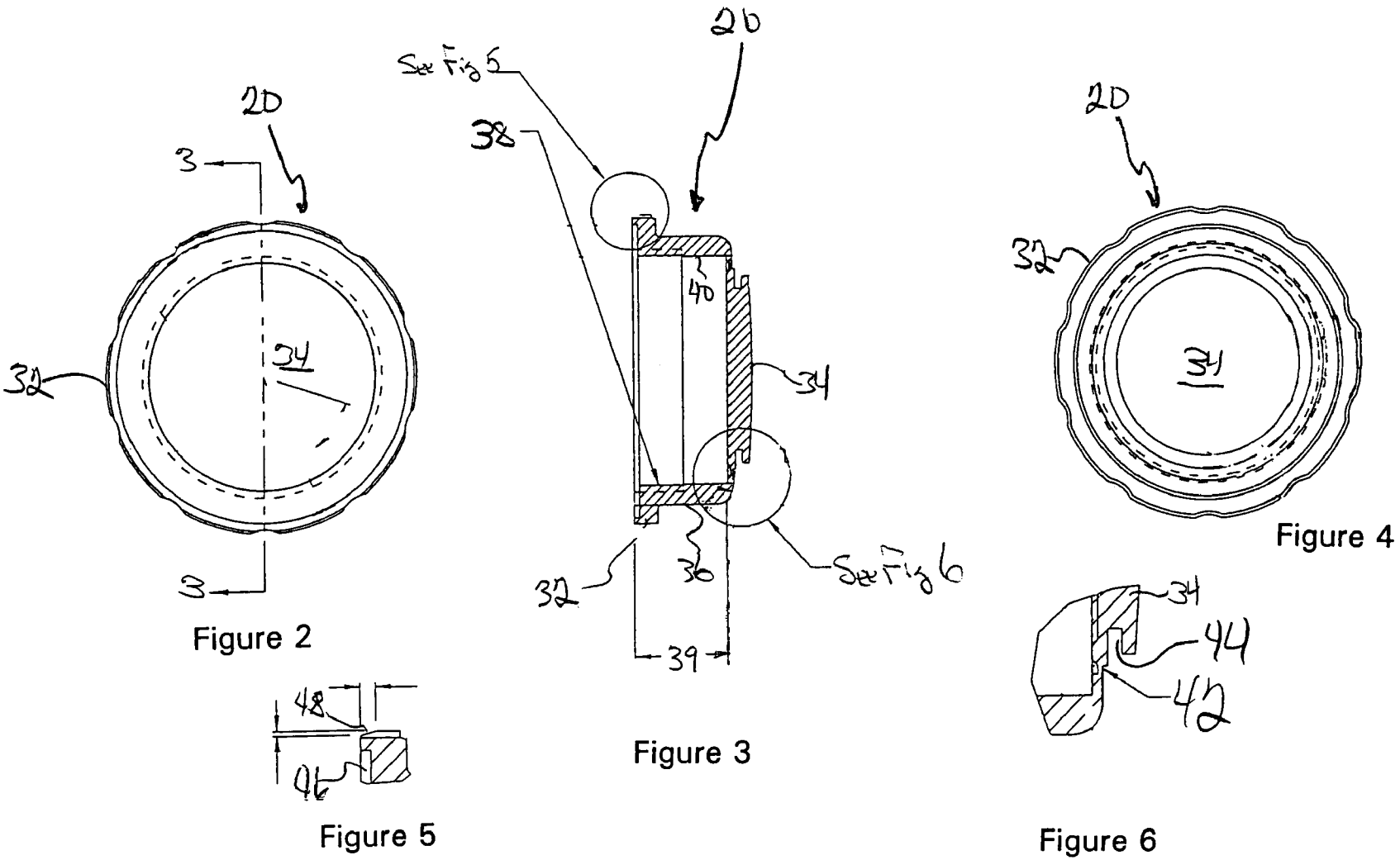
FIG. 2 is a bottom view of a retainer nut with integrally molded test cap according to aspects of the present invention.
FIG. 3 is a sectional view through the integrated retainer nut and test cap of FIG. 2 taken along line 3—3 thereof.
FIG. 4 is a top view of the integrated retainer nut and test cap of FIG. 2.
FIG. 5 is an enlargement of a peripheral portion of the retainer nut of FIG. 3.
FIG. 6 is an enlarged portion of FIG. 3 showing the connection between the periphery of the test cap and the cylindrical portion of the retainer nut.
Figure 7:
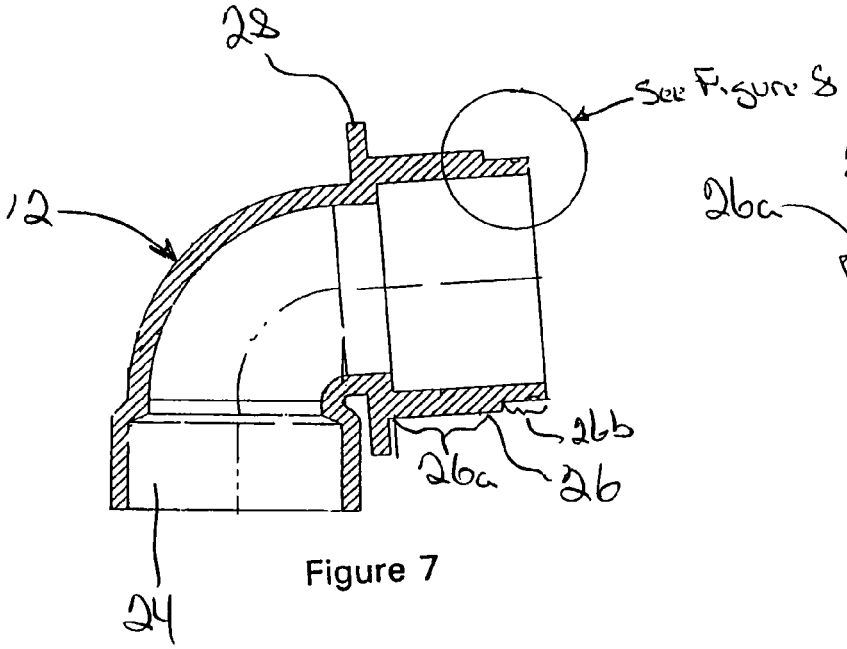
FIG. 7 is a sectional view of an overflow elbow suitable for use in conjunction with the overflow assembly according to aspects of the present invention.
Figure 8:
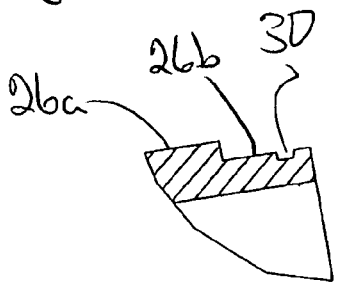
FIG. 8 is an enlarged portion of FIG. 7, showing the unthreaded section of the overflow elbow cylindrical fitting.
Figure 9:
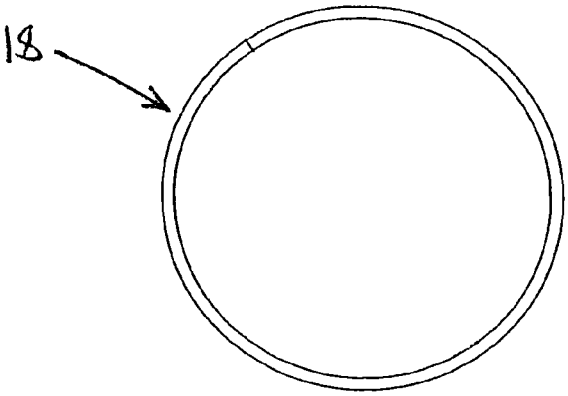
FIG. 9 is a top view of an O-ring seal suitable for use in the present invention.
Figure 10:
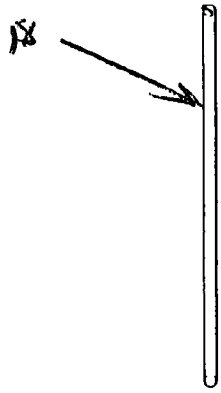
FIG. 10 is a side view of the o-ring seal of FIG. 9.
Figure 11:
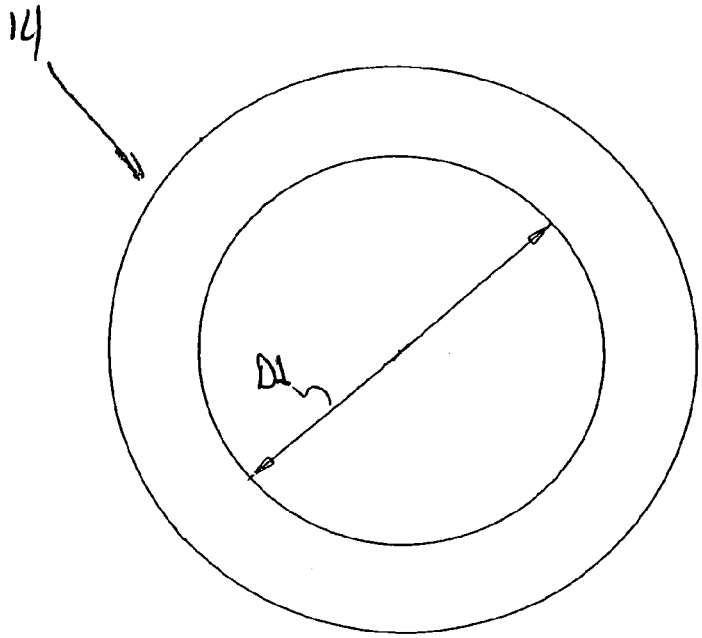
FIG. 11 is a top view of an outside gasket suitable for use in conjunction with the present invention.
Figure 12:
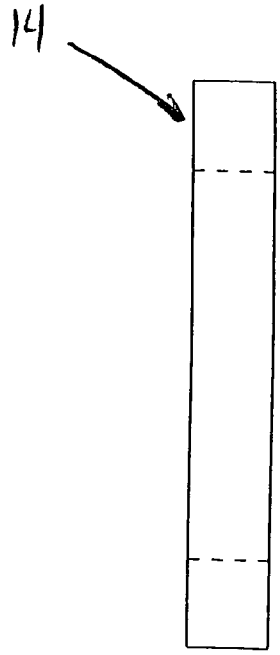
FIG. 12 is a side view of the outside gasket of FIG. 11.
Figure 13:
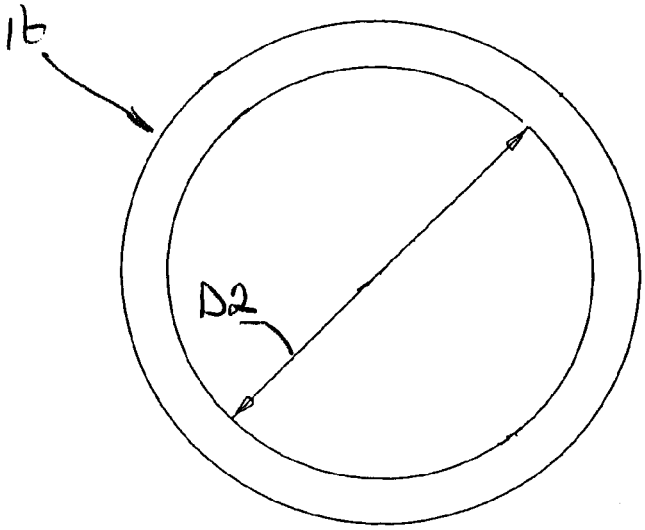
FIG. 13 is a top view of an inside gasket suitable for use in the present invention.
Figure 14:
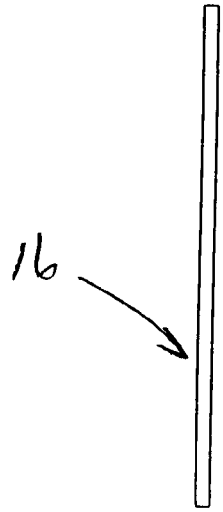
FIG. 14 is a side view of the inside gasket of FIG. 13.
Figure 15:
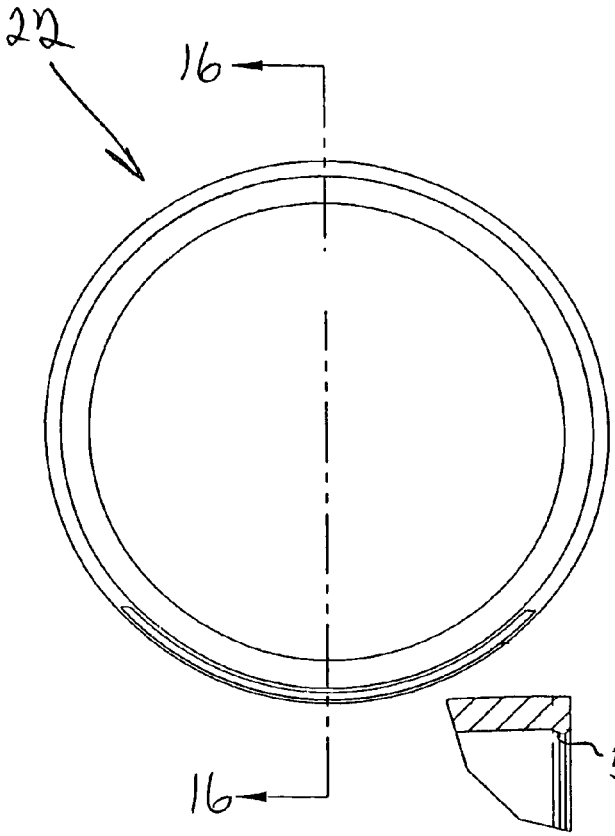
FIG. 15 is a rear view of a trim cap suitable for use in the present invention.
Figure 17:
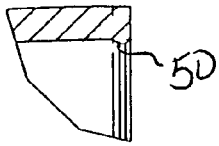
FIG. 17 is an enlarged portion of FIG. 16, illustrating the inward lip of the trim cap.
Figure 16:
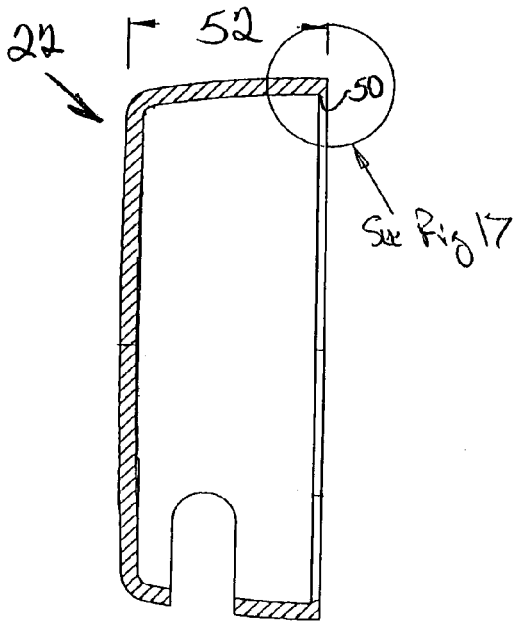
FIG. 16 is a sectional view through the trim cap of FIG. 15 taken along line 16—16 thereof.

The test cap 34 is integrally molded with the retainer nut to close the outer end of the cylindrical side wall 36. As best shown in FIG. 6, the test cap 34 is connected to the side wall 36 by a thin skin 42 of plastic. In the illustrated embodiment the thin skin 42 is approximately 0.020" thick. The integrated retainer nut/test cap is molded from ABS plastic. Experimentation has revealed that ABS has better fracturing properties than PVC. As also shown in FIG. 6, the test cap 34 includes an undercut lip 44 which facilitates use of a prying tool, such as a screwdriver, to break the thin skin 42 and remove the test cap 34. FIG. 5 is an enlarged view of the inner end 32 showing a groove 46 configured to receive the inside gasket 16 as shown in FIG. 1. The outside and inside gaskets 14, 16 are configured with inside diameters D1 and D2 slightly smaller than the outside diameter of the threaded portion 26*a* of the overflow elbow. This difference in diameter in addition to compression imposed upon the gaskets by the retainer nut 32 and corresponding flange 28 ensure proper sealing engagement between the gaskets 14, 16 and the tub wall.

FIG. 5 also illustrates an undercut beveled edge 48 at the radial periphery of the retainer nut lugs 32. This undercut beveled edge 48 engages a complementary inward projecting lip 50 on the trim cap 22. The undercut beveled edge 48 and complementary inward projecting lip 50 cooperate to provide a snap fit engagement of the trim cap 22 over those portions of the overflow assembly 10 inside the bathtub. The trim cap can be provided with a variety of decorative finishes such as chrome, brass, gold or color to provide a decorative appearance to the overflow assembly as desired. The trim cap has a depth 52 sufficient to accommodate the cylindrical fitting 26 of the overflow elbow and the corresponding cylindrical retainer nut 20.

The O-ring seal 18 enhances the sealed engagement between the cylindrical fitting 26 of the overflow elbow and the side wall 36 of the retainer nut 20. In the absence of the o-ring seal 18, it would be possible for water to traverse the coarse threads of the retainer nut and overflow elbow to cause a leak. The threads of the disclosed embodiment are approximately eight threads per inch at a diameter of approximately 2⅜". The axial dimension of the threaded portion 38 of the retainer nut is approximately 0.450". The overall depth of the retainer nut cylindrical extension is approximately 0.985".

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An overflow assembly adapted for use with a bathtub having an end wall defining an overflow opening, said overflow assembly comprising:

an overflow elbow with an inverted L-shape having an upper end portion and a lower end portion, the upper end portion including a radially extending flange and a cylindrical fitting configured to project through said overflow opening, said cylindrical fitting having an outside surface including a threaded section adjacent said flange and an unthreaded section extending axially from said threaded section;

a generally cylindrical retainer nut having a first end, a second end, an inside surface including a threaded portion adjacent said first end and an unthreaded portion between said threaded portion and said second end, and a test cap integrally molded across said second end, said test cap connected to said second end by a circumferential joint configured to break away from said retainer nut upon application of force to said test cap;

wherein said overflow elbow cylindrical fitting extends through said overflow opening and is threadably engaged by said retainer nut to clamp said end wall between said flange and said retainer nut.

2. The overflow assembly of claim 1, wherein the unthreaded section of said cylindrical fitting outside surface axially overlaps with the unthreaded portion of said retainer nut inside surface when said cylindrical fitting is threadably engaged by said retainer nut.

3. The overflow assembly of claim 2, wherein one of said unthreaded section or said unthreaded portion includes a circumferential groove and said assembly includes an O-ring seal seated in said groove for radial compression between said unthreaded section and said unthreaded portion.

4. The overflow assembly of claim 1, comprising an outside gasket compressed between said flange and an outside surface of said end wall.

5. The overflow assembly of claim 1, comprising an inside gasket compressed between said retainer nut first end and an inside surface of said end wall.

6. The overflow assembly of claim 1, wherein said test cap defines a notch for reception of a prying tool to facilitate breaking of said circumferential joint.

7. The overflow assembly of claim 1, wherein said circumferential joint comprises a circumferential region of said test cap having a thickness of approximately 0.020".

8. The overflow assembly of claim 1, wherein said retainer nut outside surface includes a plurality of radially projecting lugs adjacent said first end.

9. The overflow assembly of claim 8, comprising a trim cap configured to engage said lugs to cover said retainer nut and cylindrical fitting.

* * * * *

UNITED STATES PATENT AND TRADEMARK OFFICE

CERTIFICATE OF CORRECTION

PATENT NO. : 7,237,280 B1
APPLICATION NO. : 11/039033
DATED : July 3, 2007
INVENTOR(S) : Holden, Jr. et al.

It is certified that error appears in the above-identified patent and that said Letters Patent is hereby corrected as shown below:

After Section:

"(22) Filed: Jan. 20, 2005"

Insert:

*--Related U.S. Application Data*

(60) Provisional application No. 60/618,626, filed on Oct. 13, 2004.--

Signed and Sealed this

Thirtieth Day of October, 2007

JON W. DUDAS
*Director of the United States Patent and Trademark Office*